US006966785B2

(12) United States Patent
Taguchi

(10) Patent No.: US 6,966,785 B2
(45) Date of Patent: Nov. 22, 2005

(54) CONNECTOR

(75) Inventor: Hiroyuki Taguchi, Kanagawa (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/689,710

(22) Filed: Oct. 22, 2003

(65) Prior Publication Data

US 2004/0137770 A1 Jul. 15, 2004

(30) Foreign Application Priority Data

Oct. 23, 2002 (JP) ..... 2002-308948

(51) Int. Cl.[7] ..... H01R 13/648
(52) U.S. Cl. ..... 439/108; 439/326
(58) Field of Search ..... 439/108, 630, 439/326, 181

(56) References Cited

U.S. PATENT DOCUMENTS

| | | | | |
|---|---|---|---|---|
| 4,812,947 | A * | 3/1989 | Belanger et al. | 361/220 |
| 5,288,247 | A | 2/1994 | Kaufman | |
| 5,299,946 | A * | 4/1994 | Kusakabe | 439/159 |
| 5,308,251 | A * | 5/1994 | Kaufman et al. | 439/64 |
| 5,398,154 | A * | 3/1995 | Perkins et al. | 361/212 |
| 5,425,651 | A * | 6/1995 | Thrush et al. | 439/326 |
| 5,725,394 | A * | 3/1998 | Banakis et al. | 439/607 |
| 5,984,698 | A * | 11/1999 | Hirata | 439/101 |
| 6,027,348 | A * | 2/2000 | Lai et al. | 439/92 |
| 6,074,223 | A * | 6/2000 | Huang | 439/95 |
| 6,077,088 | A * | 6/2000 | Yu et al. | 439/64 |
| 6,354,876 | B1 | 3/2002 | Yu | |
| 6,413,109 | B1 * | 7/2002 | Kobayashi et al. | 439/326 |
| 6,475,005 | B2 * | 11/2002 | Yu | 439/157 |
| 6,692,271 | B2 * | 2/2004 | Watanabe | 439/108 |

FOREIGN PATENT DOCUMENTS

| | | | |
|---|---|---|---|
| EP | 0228278 | * | 7/1987 |
| EP | 0926780 | A2 | 6/1999 |
| EP | 0932226 | A2 | 7/1999 |
| EP | 11195466 | A1 | 7/1999 |
| EP | 0932226 | A3 | 4/2000 |
| EP | 0926780 | A3 | 11/2000 |
| JP | 5-13131 | A1 | 1/1993 |
| JP | 5-34680 | A1 | 5/1993 |
| JP | 5-152025 | A1 | 6/1993 |
| JP | 6-19283 | U | 3/1994 |
| JP | 8-180942 | A1 | 7/1996 |
| JP | 3055342 | U | 10/1998 |

(Continued)

*Primary Examiner*—Tho D. Ta
*Assistant Examiner*—Larisa Tsukerman
(74) *Attorney, Agent, or Firm*—Rader, Fishman & Grauer PLLC

(57) ABSTRACT

The connector includes a card and a housing for housing the card. The housing includes a non-conductive housing main body having a housing space for housing the card, a contact for connecting the card, the contact being disposed in the housing main body, and a first conductor portion for connecting the card in the housing space, the first conductor portion being disposed in the housing main body but insulated from the contacts. According to the invention, the connector is first connected to the board and the board is grounded. Next, the card is inserted into the housing space. The card and the first conductor portion are thus connected each other. Then, electric charge electrified on the card face transfers to the ground through the first conductor portion and the board. Consequently, the electrical charge electrified on the card can be easily eliminated.

19 Claims, 8 Drawing Sheets

FOREIGN PATENT DOCUMENTS

| | | | |
|---|---|---|---|
| JP | 11-195466 | A1 | 7/1999 |
| JP | 11-195467 | A1 | 7/1999 |
| JP | 2001-176624 | A1 | 6/2001 |
| JP | 2003-203692 | A1 | 7/2003 |
| JP | 2003-203718 | A1 | 7/2003 |
| JP | 2003-203719 | A1 | 7/2003 |
| JP | 2003-249314 | A1 | 9/2003 |
| JP | 2003-317892 | A1 | 11/2003 |

* cited by examiner

CONNECTOR

BACKGROUND OF THE INVENTION

1. Technical Field

This present invention relates to a connector. More particularly, the present invention relates to a connector for connecting a board having a card and a housing for housing the card.

2. Background Art

Conventionally, connectors having a card and a housing for housing the card are known. One of such connectors has a projection on a bottom face of a flat housing (JP-A-11-195466), for example the projection is fitted into positioning hole formed on a printed wiring board and thus positioning of the connector is achieved. Another connector has a lead portion and a reinforcing lead portion (JP-A-11-195467). The lead portion and the reinforcing lead portion are soldered to a printed wiring board In the connectors described above, however, electronic components may exhibit erroneous operations due to electric charge which is electrified on the card. In order to solve this problem, a lead wire for grounding may be provided on a board. However, with the above-described connector, the mechanism of the connector is complicated and the reduction of the size of the connector is difficult.

DISCLOSURE OF THE INVENTION

Therefore, an object of the present invention is to provide a connector capable of easily eliminating electric charge electrified on a card inserted into a housing.

To accomplish this object, the present invention provides the followings.

(1) A connector for connecting a grounded board, said connector having a card and a housing for housing said card, said housing comprising: a non-conductive housing main body having an housing space for housing said card; a contact for connecting said card housed in housing space, said contact being disposed in said housing main body; and a first conductor portion for connecting said card housed in said housing space, said first conductor portion being disposed in said housing main body and insulated from said contact, and whereby said first conductor portion escaping electric charge electrified on said card to said board when connected to said card and said board.

Here, the card includes a card in which a memory or a chip is assembled. Concrete examples of the card include SIMM, DIMM, PC cards, smart media, compact flash (registered trademark), and so on. The planar shape of the card is not particularly limited and may be round, rectangular or polygonal.

The insert direction of the card into the housing space is not particularly limited. The card may be inserted along an extending direction of the housing space, for example, or may be inserted at a predetermined angle to the extending direction of the housing space.

The term "connecting a grounded board" means not only the state where the connector is fixed to the board but also the state where the connector is held on the board with a certain degree of freedom while a flexible member is provided between the connector and the board, for example.

The position and the number of connection terminals of the card to connect the contact are not limited, in particular, but may be decided appropriately. The connection terminals of the card are formed of a metal, for example.

The position, number, shape and structure of the contact is not particularly limited. For example, the contact is formed of a material elastically deformable and the rear end side of the contact is supported on the housing in cantilever while front end side of the contact protrudes into the housing space. According to this arrangement, the contact can keep contact with the card with predetermined push force. The fixing method of the contact to the housing is not particularly limited. The contact may be fixed to the housing by means such as push-in, integral molding (insert molding), and so on.

The material for forming the housing is not particularly limited so long as it is an electrically non-conductive material and is a synthetic resin, for example. The housing space of the housing is not particularly limited in the shape and size.

The first conductor portion is preferably connected to the portion of the card having non-conductivity. For, the transfer of the electric charge is restricted much more on the non-conductive portion than on the conductive portion, and a greater amount of the electric charge is electrified on the non-conductive portion. The first conductor portion may be a rail and the rail may guide the card into the housing space, for example.

According to the present invention, the connector is first connected to the board and the board is then grounded. Next, the card is inserted into the housing space. Consequently, the card and the first conductor portion are connected. Then, the electric charge electrified on the card face transfers to the ground through the first conductor portion and the board due to the potential difference between the first conductor portion and the card face. The charge electrified on the card can thus be eliminated easily.

(2) The connector described in (1), wherein said first conductor portion is disposed in a position to connect said card which is not housed in said housing space.

The term "a position to connect said card which is not housed in the housing space" is a position in the proximity of the insert face of the housing space through which the card is inserted, for example.

According to the present invention, the electric charge electrified on the face of the card can be eliminated before the card contacts the contact, and an erroneous operation of the board can be prevented.

(3) The connector described in (1) or (2), wherein said first conductor portion is for connecting an edge of the card.

According to the present invention, the first conductor portion can guide an edge of the card to the housing space. Therefore, the card can be easily inserted into the housing.

(4) The connector described in any one of (1) to (3), further comprising: a second conductor portion disposed along a second side face of said housing space; wherein said first conductor portion is disposed along a first side face of said housing space.

According to the present invention, the first and second conductor portions can more surely guide the edge of the card to the housing space. Therefore, the card can be more easily inserted into the housing.

(5) The connector described in (4), further comprising another second conductor portion disposed along another second side face of said housing space, said another second side face being opposite to the second side face, wherein said card is substantially rectangular and said second conductor portions are symmetrically disposed about the direction of inserting said card.

According to the present invention, the card can be held between the second conductor portion and said another second conductor portion. Therefore, reduction of the size of the connector can be accomplished.

(6) The connector described in (5), wherein each of said second conductor portions has a flexible portion elastically deformable outside and a lock piece disposed along said flexible portion for covering a portion of a face of said housing space for being inserted said card; whereby said lock pieces is pushed by said card to open outside when said card is inserted into said housing space, and said lock pieces lock said card when said card is housed in said housing space.

According to the present invention, when the card is inserted into the housing, the edge of the card pushes and slides along the edge of the lock piece. Consequently, the lock piece and the flexible portion are pushed by the card and bent outside. When the card is housed in the housing space, the push force of the card to the lock piece is released. The lock piece returns to its initial position due to the elastic restoring force of the flexible portion and locks the card. Therefore, it is possible to prevent the card from falling off from the housing.

(7) The connector described in any one of (1) to (6), wherein said board is a printed wiring board.

(8) The connector described in any one of (1) to (7), wherein said contact is for connecting said board.

Moreover, the contact is electrically connected to the board in soldering to be fixed to the board, for example. Accordingly, the contact need not be fixed to the board by an adhesive, or the like. Therefore, the size of the connector can be reduced.

(9) An electronic component having a connector for connecting to a grounded board, said connector having a card and a housing for housing said card, said housing comprising: a non-conductive housing main body having an housing space for housing said card, a contact for connecting said card housed in said housing space, said contact being disposed in said housing main body; and a first conductor portion for connecting said card housed in said housing space, said first conductor portion being disposed in said housing main body and insulated from said contact; and whereby said first conductor portion escapes charge built up in said card to said board when connected to said card and said board.

Such an electronic component is assembled into a computer or a cellular telephone unit, for example.

PREFERRED EMBODIMENTS OF THE INVENTION

Figure 1:
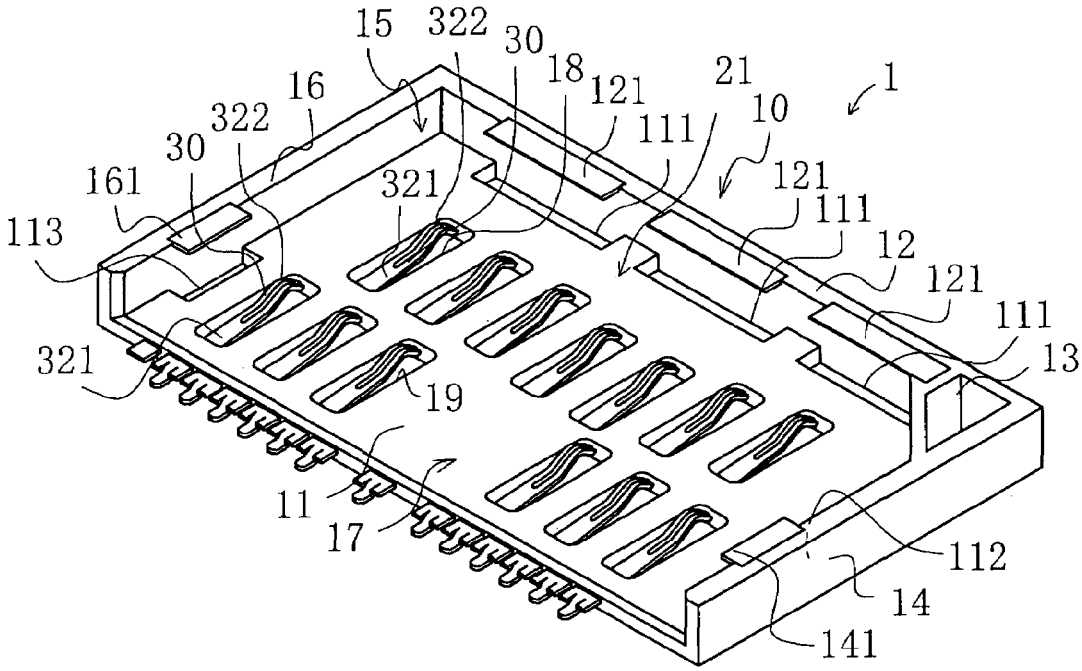
FIG. 1 is an general perspective view showing a connector according to a first embodiment of the present invention.

Embodiments of the present invention will be described hereinafter by referring to the drawings. In the description of the embodiments below, the same numerals are applied to the same structural elements and the description therefore and the description therefore will be omitted or simplified.

First Embodiment

Figure 2:
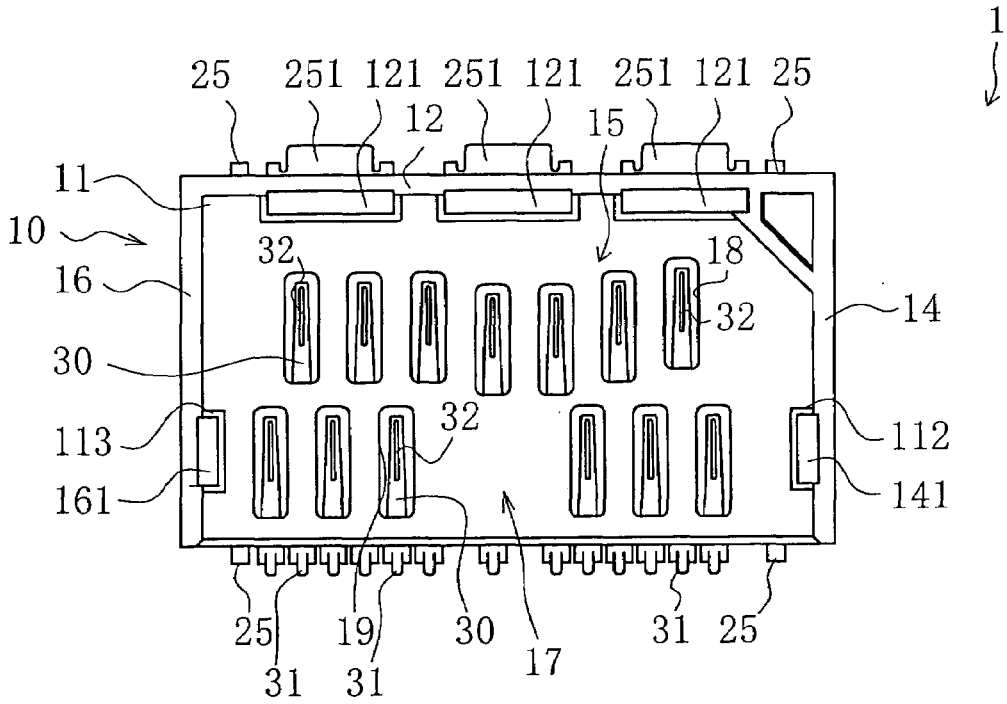
FIG. 2 is a plan view of the connector according to the first embodiment.

FIG. 1 is a general perspective view of a connector 1 according to the first embodiment. FIG. 2 is a plan view of the connector 1.

The connector 1 has a substantially rectangular card not shown, a housing 10 capable of housing the card and a plurality of contacts 30 held in the housing 10.

The housing 10 is formed of resin and has a flat rectangular housing base portion 11, a wall portion 12 installed upright along an edge of the housing base portion 11, and two wall portions 14, 16 installed upright along edges of the housing portion 11 between which the wall portion 12 is sandwiched.

Here, the wall portion 14 is disposed on the forehand side in FIG. 1 and the wall portion 16 is disposed on the depth side in FIG. 1. A lug corner 13 having a substantially triangular shape is formed at the corner between the wall portion 14 and the wall portion 12. This lug corner 13 makes later-described open face 15 asymmetric and can prevent a mistake of the right and left sides of the card when it is inserted.

the housing base portion 11 and the wall portions 12, 14, 16 define a housing space 21. In other words, the housing space 21 has a first side face covered with the wall portion 12, two second side faces adjacent to the first side face and covered with the wall portions 14, 16, an open face 17 positioned on the opposite side to the first side face, and an open face 15 adjacent to the first side face, the second side face and the open face 17.

The housing base portion 11 has three openings 111 formed along the wall portion 12, an opening 112 formed along the wall portion 14, and an opening 113 formed along the wall portion 16.

The wall portion 12 has three conductor portions 121, each of which is disposed in face-to-face relationship with the openings 111 and covers a part of the open face 15. A front end of a card is engaged to the conductor portions 121. The wall portion 14 has a conductor portion 141 disposed in face-to-face relationship with the opening 112 and covering a part of the open face 15. The wall portion 16 has a conductor portion 161 disposed in face-to-face relationship with the opening 113 and covering a part of the open face 15.

The housing base portion 11 has seven openings 18 which are formed on the side of the wall portion 12 and extend along the wall portions 14, 16. On the other hand, the housing base portion 11 has six openings 19 which are formed on the side of the open face (on the opposite side to the wall portion 12) and extend along the wall portions 14, 16. Three out of six openings 19 are disposed unevenly on the sides of the wall portion 14 and the other three openings 19 are disposed unevenly on the sides of the wall portion 16.

Figure 3:
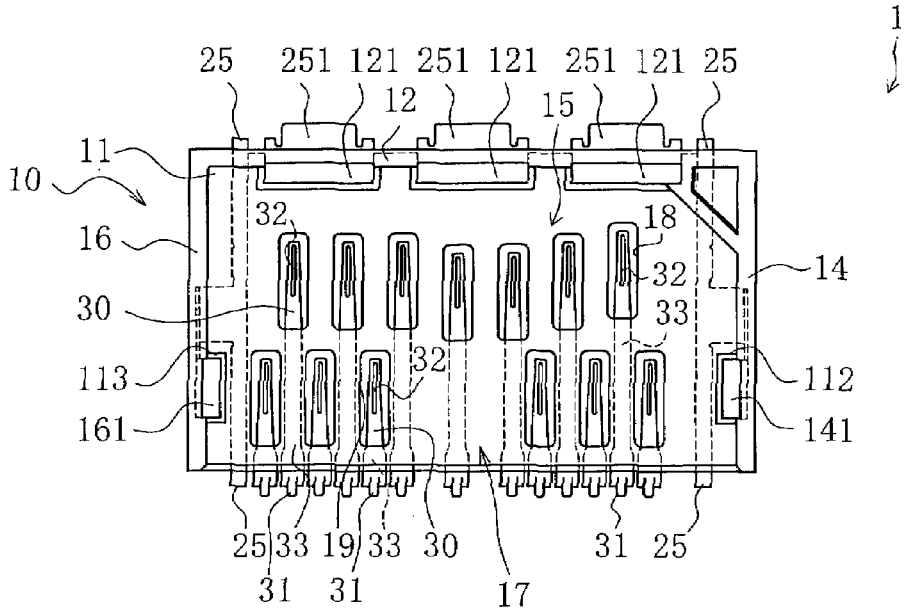
FIG. 3 is a plan view of contacts of the connector according to the first embodiment.

The number of the contacts 30 is thirteen and the contacts 30 are formed of a metal. Each contact 30 has a buried portion 33 (indicated by dash line in FIG. 3) buried in the housing 10, a lead wire connection portion 31 formed at one end of the buried portion 33 and capable of connecting a lead wire, and a card connection portion 32 formed at the other end of the buried portion 33 and capable of connecting the card under inserted state.

Among them, the card connection portion 32 is arranged in the opening 18, 19 of the housing base portion 11. The card connection portion 32 has a spring portion 321 supported in a cantilever fashion at the edge of the opening 214 and a projection 322 disposed at the front end of the spring portion 321. The spring portion 321 is elastically deformable and inclines towards the card progressively from its rear end to its front end. In consequence, the projection 322 protrudes into the housing space 21 and can keep a satisfactory contact pressure against the card.

The housing base portion 11 has a frame member 25 formed of metal and buried therein. The frame member 25 extends in a substantially bracket-shaped sectional shape along the wall portions 12, 14, 16. The frame member 25 is interconnected to the conductor portions 121, 141, 161 and is exposed from the side of the open face side and the wall portion 12 of the housing base portion 11. The frame member 25 has three solder portions 251 exposed from the side of the wall portion 12 of the housing base portion 11 at corresponding position of the conductor portions 121 as shown in FIG. 2. The solder portions 251 extend to the back of the housing base portion 11 and are soldered to a wiring board not shown in the drawing. Moreover, the frame member 25 can prevent deformation of the housing 10 due to a residual stress at the time of molding of the housing 10 and an external stress.

Next, a procedure for inserting the card to the housing will be described.

Figure 4:
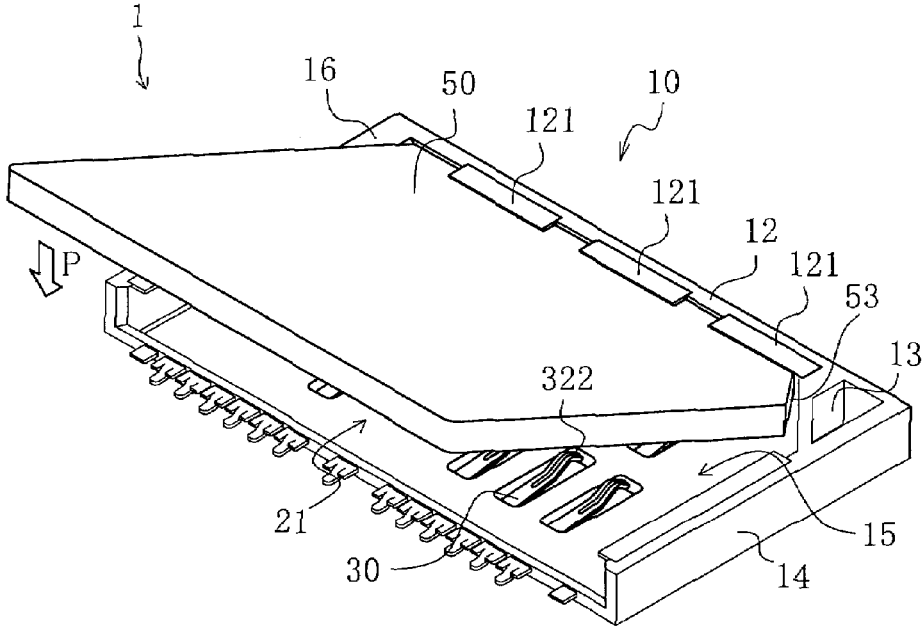
FIG. 4 is a perspective view for explaining a procedure of inserting a card to a housing according to the first embodiment.

As shown in FIG. 4, the card 50 (indicated by two-dot-chain line in FIG. 4) is first prepared. The card 50 is substantially rectangular and is cut off at a corner of its one end to form a notch 53. The card 50 has connection terminals to connect the projections 322 of the contacts 30.

Next, one end of the card 50 is inserted between the conductor portion 121 and the housing base portion 11 into the side of the open face 17 of the housing space 21 so that the notch 53 of the card 50 is fitted into the lug corner 13 until the card 50 contacts the wall portion 12. The angle between the card 50 and the open face 15 at this time is from 10 to 30 degrees, for example.

The other end of the card 50 is pushed in a direction indicated by an arrow P in FIG. 4 and is rotated. Then, the card 50 rotates with the one end of the card 50 engaging the conductor portion 121 as the center of the rotation.

The one end of the card 50 is inserted into the open face 15 but the other end of the card 50 is not inserted into the open face 15 under this state.

The other end of the card 50 is subsequently rotated further in the direction indicated by the arrow P in FIG. 4. Edges of the lower face of the card 50 then push the conductor portions 141, 161. Consequently, the one end of the card 50 comes into contact with the conductor portions 121, 141, 161 and electric charge electrified on the face of the card 50 transfers to the wiring board, not shown, through the conductor portions 121, 141, 161.

When the other end of the card 50 is further rotated, the conductor portions 141, 161 are deformed outside.

When the card 50 is housed in the housing space 21 as a result of rotation of the card 50, the push force of the card 50 to the conductor portions 141, 161 is released. Therefore, the conductor portions 141, 161 move inside due to elastic restoring force and return to their initial positions and their lower faces lock the upper face of the card 50.

Figure 5:
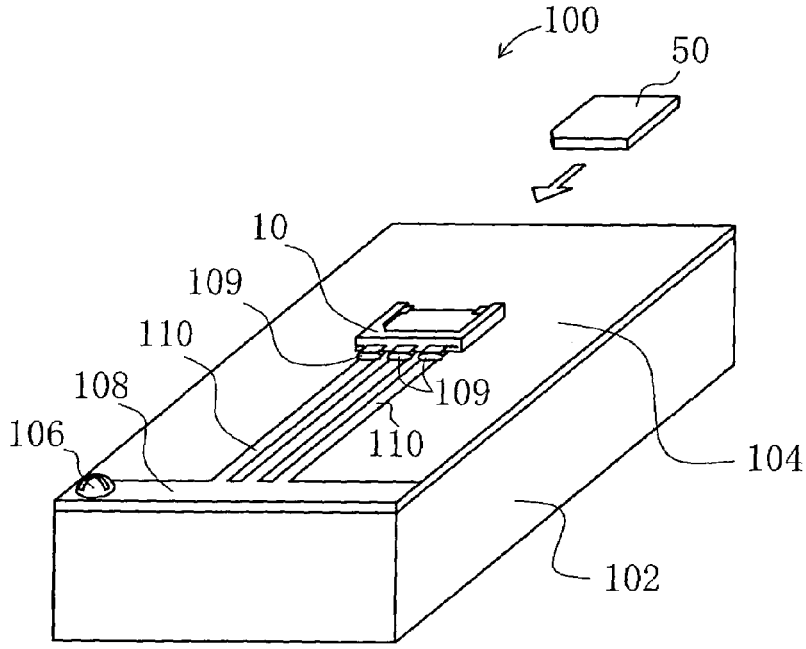
FIG. 5 is a perspective view showing an electronic component including the connector according to the first embodiment.
Figure 6:
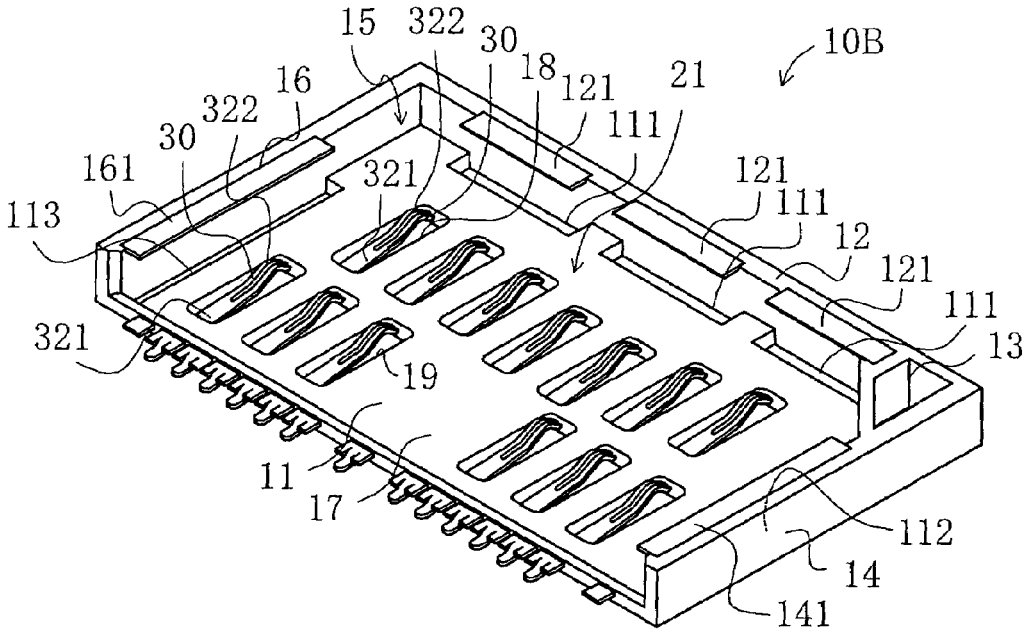
FIG. 6 is a general perspective view showing a connector according to a second embodiment of the present invention.
Figure 7:
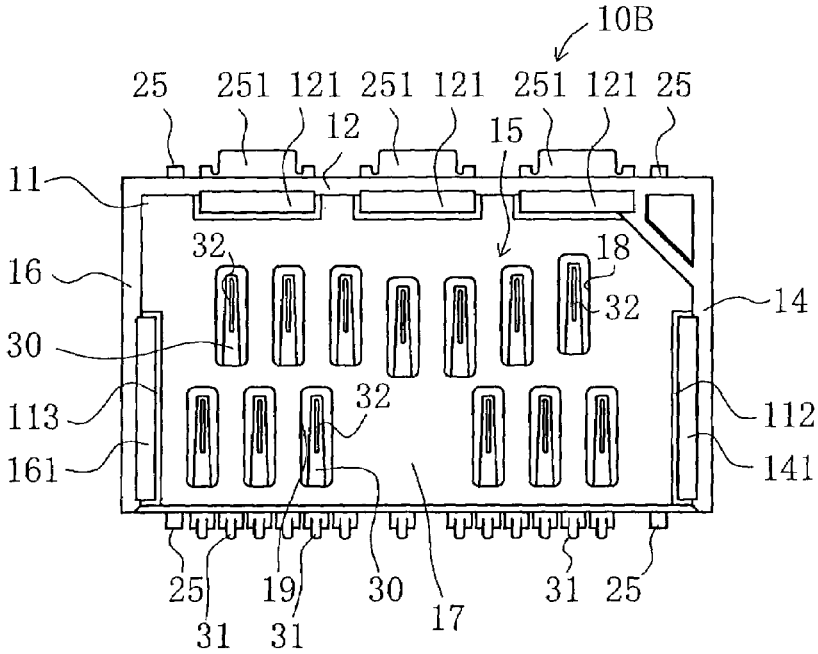
FIG. 7 is a plan view of the connector according to the second embodiment.
Figure 8B:
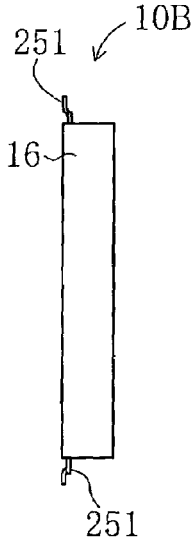
FIG. 8B is a side view of the connector according to the second embodiment.
Figure 8A:
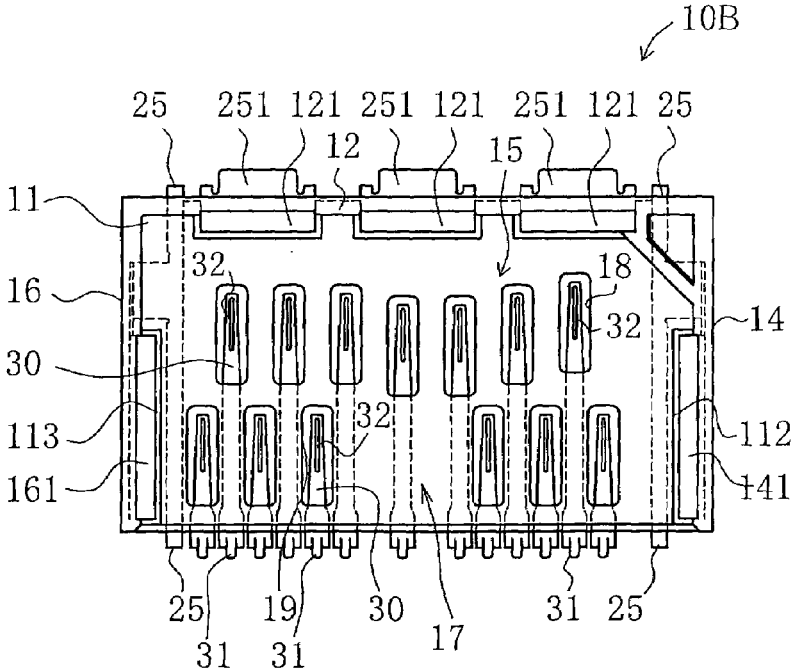
FIG. 8A is a plan view of contacts of the connector according to the second embodiment.
Figure 9:
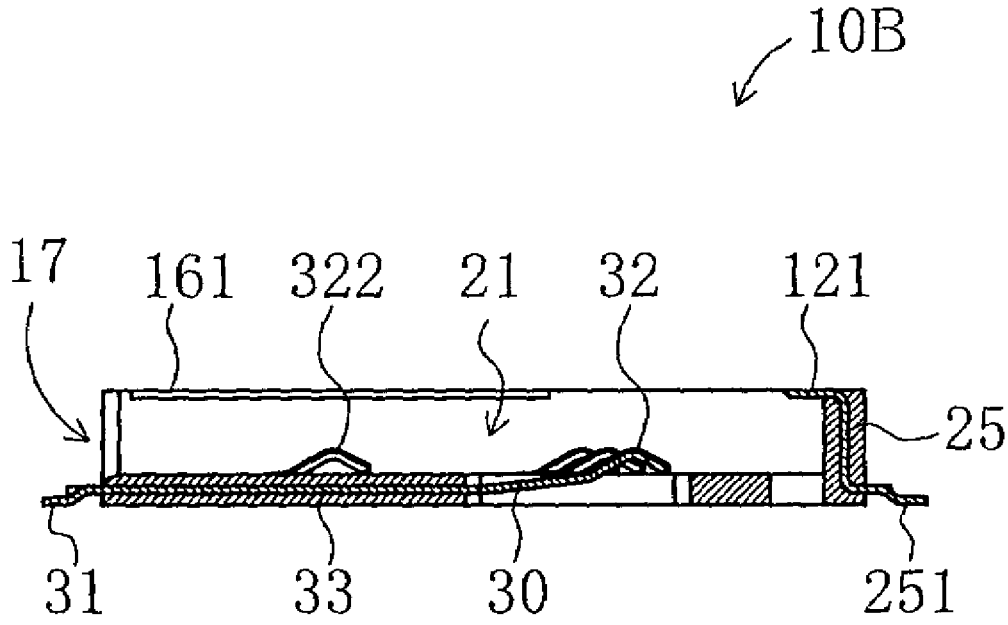
FIG. 9 is a sectional view of the connector according to the second embodiment.
Figure 10:
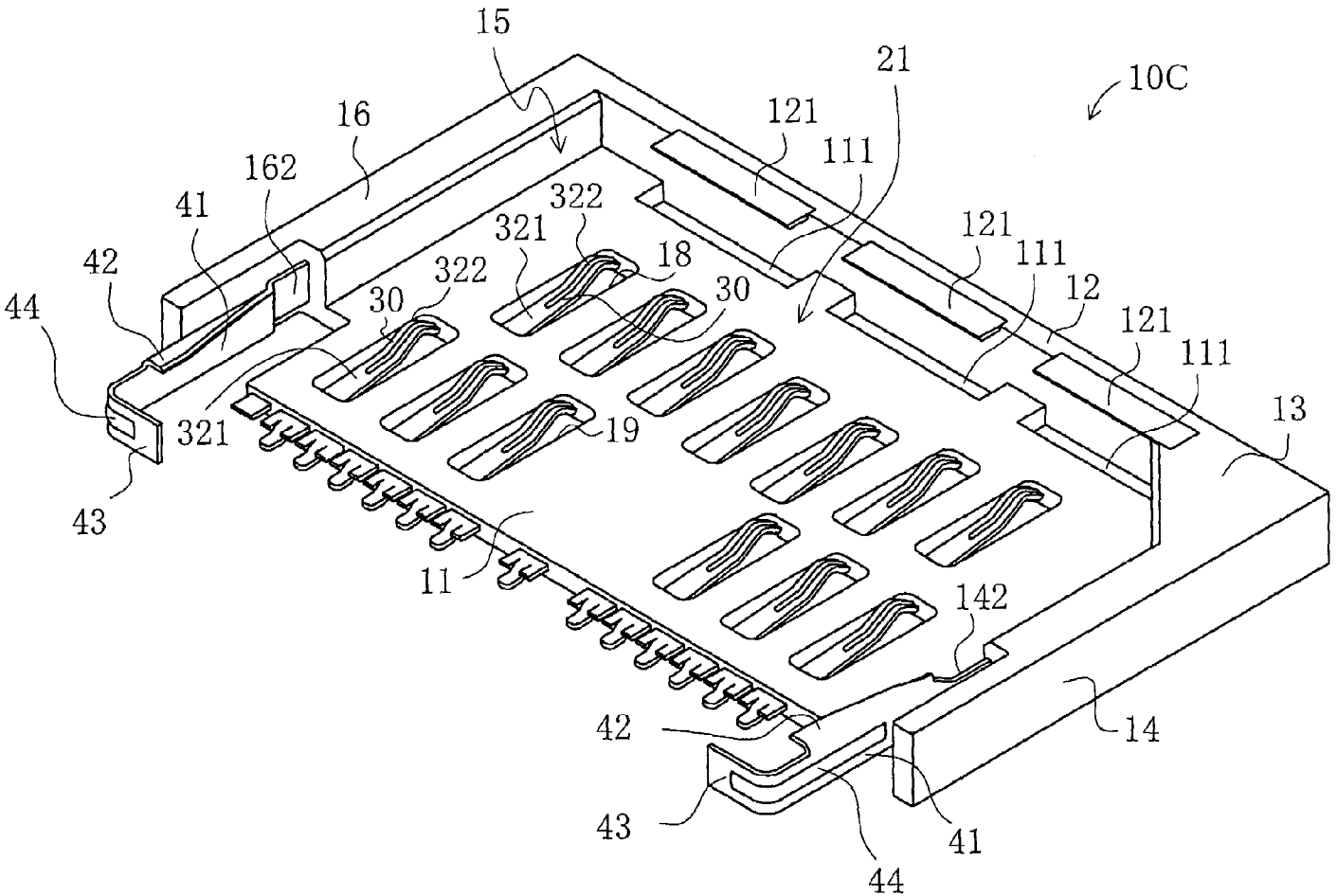
FIG. 10 is a general perspective view showing a connector according to a third embodiment of the present invention.
Figure 11:
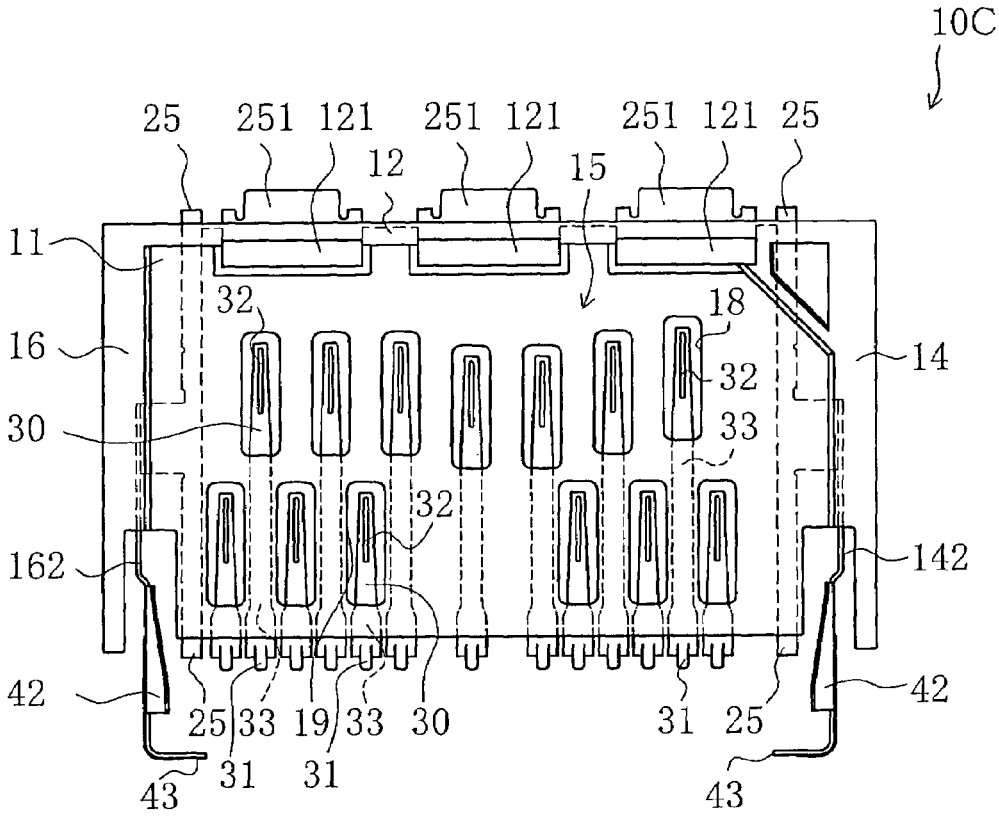
FIG. 11 is a plan view of contacts of the connector according to the third embodiment.
Figure 12:
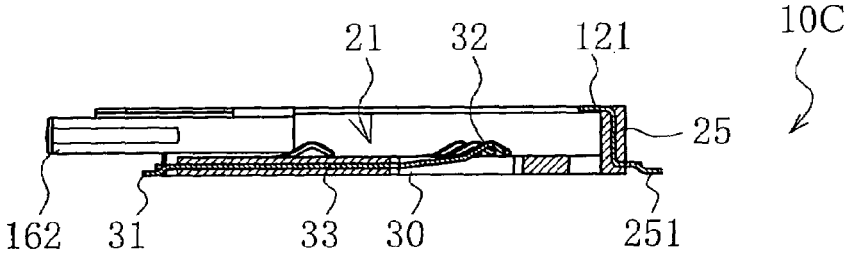
FIG. 12 is a sectional view of the connector according to the third embodiment.
Figure 13:
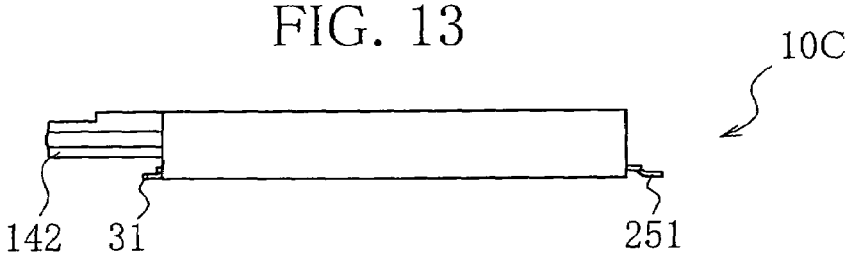
FIG. 13 is a side view of the connector according to the third embodiment.

The connector 1 described above is mounted to an electronic component 100 as shown in FIG. 5. In other words, the electronic component 100 includes a chassis 102, and a printed wiring board 104 fixed by a screw 106 onto the chassis 102.

The printed wiring board 104 has the connector 1, a ground electrode 108, and wires 110 connecting the connector 1 to the ground electrode 108. The connector 1 is soldered to the solder portion 109 of the wire 110. The ground electrode 108 is electrically connected to the chassis 102 through a screw 106.

According to this electronic component 100, the electric charge electrified on the face of the card 50 transfers to the ground through the wire 110, the ground electrode 108, and the screw 106 when the card 50 is inserted into the housing 10.

Second Embodiment

In this embodiment, the length of the conductor portions 141, 161 are different from the length thereof in the first embodiment.

More specifically, as shown in FIGS. 6, 7, 8A, 8B, 9, the conductor portions 141, 161 extend to the open face 17 of the housing space 21.

Since the length of the conductor portions 141, 161 is elongated in this embodiment, the conductor portions 141, 161 contact the card 50 easily and the electric charge electrified on the card 50 can be transferred more easily. In addition, the card 50 can be held more surely because the contact area between the upper face of the card 50 and the lower faces of the conductor portions 141, 161 is increased.

Third Embodiment

In this embodiment, the construction of the conductor portions 142, 162 are different from the construction in the first embodiment.

More specifically, as shown in FIGS. 10 to 13, the conductor portions 142, 162 are disposed on the extension of the wall portions 14, 16.

Each conductor portion 142, 162 has an elastically deformable flexible portion 41 supported by the wall portions 14, 16 and extending along the second side face of the housing space 21, a first lock piece 42 disposed along the flexible portion 41 for covering a portion of the open face 15 and a second lock piece 43 which is disposed substantially perpendicularly with respect to the longitudinal axis of the flexible portion 41 for covering a part of the open face 17.

The flexible portion 41 is deformable elastically and is supported in a cantilever fashion at a cutaway portion formed inside one end face of each wall portion 14, 16. Moreover, a reinforcing dimple 44 for improving rigidity is formed at the intersection between the flexible portion 41 and the second lock piece 43. The reinforcement dimple 44 is formed simultaneously when the conductor portions 142, 162 are press molded.

The first lock piece 42 has a taper shape such that it expands progressively at a predetermined angle from the rear end side towards its front end side of the flexible portion 41. The first lock piece 42 includes a slope 421 sloping increasingly from the rear end to the front end. The slope 421 is formed at the edge of the first lock piece 42. More concretely, the angle between the slope 421 and the open face 15 is 0 degrees on the rear end side of the first lock piece 42. The angle between the slope 421 and the open face 15 is a predetermined angle on the front end side of the first lock piece 42.

Although not shown in the drawing, intersections between the slope 421 and other surfaces in the first lock piece 42 are chamfered.

Figure 14:
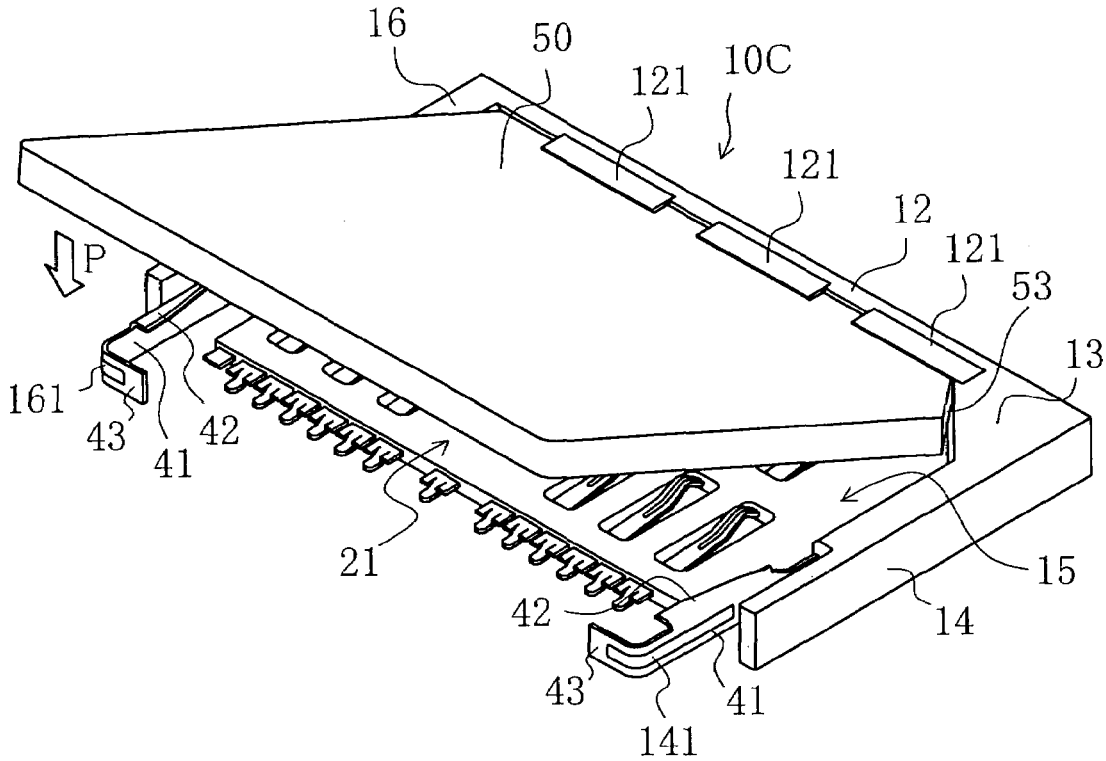
FIG. 14 is a perspective view for explaining a procedure of inserting a card to a housing according to the third embodiment.

Next, the procedure for inserting the card to the housing will be described with reference to FIG. 14.

First, a card 50 is prepared. Next, one end of the card 50 is inserted between the conductor portion 121 and the housing base portion 11 until it contacts the wall portion 12 so that the notch 53 of the card 50 is fitted into the lug corner 13. The other end side of the card 50 is thereafter pushed in the direction of the arrow P in FIG. 14 and is rotated. Then, the card 50 rotates with its one end side engaging the conductor portion 121 as the center of rotation.

One end of the card 50 is inserted into the open face 15 under this state but the other end of the card 50 is not inserted into the open face 15. In other words, the edges of the lower face of the card 50 intersect the slope 421 of the first lock piece 42. Therefore, when the card 50 rotates, the edge of the lower face of the card 50 comes into contact with the slope 421 of the first lock piece 42 because the first lock piece 42 covers a part of the open face 15. That is, the card 50 comes into contact with the first lock piece 42 at an lengthwise intermediate portion of the card 50.

Subsequently, the other end side of the card 50 is further rotated in the direction of the arrow P in FIG. 14. Then, the end edges of the lower face of the card 50 slide away from the conductor portion 121 along the slopes 421 of the first lock pieces 42 while pushing this slope 421.

In consequence, the first lock piece 42 and the flexible portion 41 are pushed by the card 50 so that they are elastically deformed outside.

When the card 50 is housed in the housing space 21 as a result of the rotation of the card 50, the first lock piece 42 is released from pushing force of the card 50. Therefore, the first lock piece 42 is moved inside due to the elastic restoring force of the flexible portion 41 and returns to its initial position so that lower face of the first lock piece 42 locks the upper face of the card 50. The second lock piece 43 locks the side face of the card 50.

The present invention is not limited to the embodiments described above but includes the modifications and improvements which achieve the object of the invention.

Figure 15:
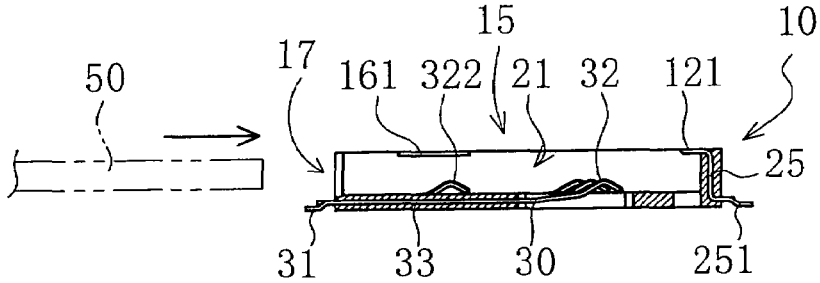
FIG. 15 is a sectional view for explaining another procedure of inserting the card to the housing according to each of the embodiments described above.

For example, in the first to third embodiments, the card 50 is inserted through the open face 15 but the present invention is not limited thereto. In other words, the card 50 may well be inserted into the housing space 21 through the open face 17 of the housing space 21 of the housing 10 as shown in FIG. 15.

The connector according to the invention provides the following advantages.

The connector is first connected to the board and the board is then grounded. Next, the card is inserted into the housing space. Consequently, the card and the first conductor portion are connected. Then, electric charge electrified on the card face transfers to the ground through the first conductor portion and the board due to the potential difference between the first conductor portion and the card face. The charge electrified on the card can thus be eliminated easily.

What is claimed is:

1. A connector for connecting a grounded board, said connector having a housing for housing a card to be connected, said housing comprising:

a non-conductive housing main body having a housing space for housing said card, the housing space being defined by a first side face and opposing second side faces adjacent to the first side face;

a contact for connecting said card housed in said housing space, said contact being disposed in said housing main body;

a first conductor portion for connecting said card housed in said housing space, said first conductor portion being disposed on the first side face and insulated from said contact; and a second conductor portion disposed on the second side face of said housing main body and insulated from said contact, whereby said first and second conductor portions escaping electric charge electrified on said card to said board when connected to said card and said board.

2. The connector according to claim 1, wherein said first conductor portion is disposed in a position to connect said card which is not housed in said housing space.

3. The connector according to claim 2, wherein said board is a printed wiring board.

4. The connector according to claim 2, wherein said contact is for connecting said board.

5. The connector according to claim 1, wherein said first conductor portion is for connect an edge of said card.

6. The connector according to claim 1, further comprising another second conductor portions disposed on the other second side face of said housing space, said the other second side face being opposite to the second side face, wherein, said card is substantially rectangular and said second conductor portions are symmetrically disposed about the direction of inserting said card.

7. The connector according to claim 6, wherein each of said second conductor portions has a flexible portion elastically deformable outside and a lock piece disposed along said flexible portion for covering a portion of a face of said housing space for being inserted said card;

whereby said lock pieces is pushed by said card to open outside when said card is inserted into said housing space, and said lock pieces lock said card when said card is housed in said housing space.

8. The connector according to claim 1, wherein said board is a printed wiring board.

9. The connector according to claim 1, wherein said contact is for connecting said board.

10. An electronic component having a connector for connecting to a grounded board, said connector having a card and a housing for housing said card, said housing comprising:

a non-conductive housing main body having an housing space for housing said card, the housing space being defined by a first side face and opposing second side faces adjacent to the first side face;

a contact for connecting said card housed in said housing space, said contact being disposed in said housing main body;

a first conductor portion for connecting said card housed in said housing space, said first conductor portion being disposed on of the first side face and insulated from said contact; and a second conductor portion disposed on the second side face of said housing main body and insulated from said contact, whereby said first and second conductor portions escapes charge built up in said card to said board when connected to said card and said board.

11. The connector according to claim 2, wherein said first conductor portion is for connect an edge of said card.

12. The connector according to claim 1, further comprising another second conductor portions disposed on the other second side face of said housing space, said the other second side face being opposite to the second side face, wherein said card is substantially rectangular and said second conductor portions are symmetrically disposed about the direction of inserting said card.

13. The connector according to claim 12, wherein each of said second conductor portions has a flexible portion elastically deformable outside and a lock piece disposed along said flexible portion for covering a portion of a face of said housing space for being inserted said card;

whereby said lock pieces is pushed by said card to open outside when said card is inserted into said housing space, and said look pieces lock said card when said card is housed in said housing space.

14. The connector according to claim 11, wherein said board is a printed wiring board.

15. The connector according to claim 11, wherein said contact is for connecting said board.

16. A connector for connecting a grounded board, said connector having a card and a housing for housing said card, said housing comprising:

a non-conductive housing main body having an housing space for housing said card;

a contact for connecting said card housed in housing space, said contact being disposed in said housing main body;

a second conductor portion for connecting said card housed in said housing space, said second conductor portion being disposed in said housing main body and insulated from said contact, said conductor portion being disposed along one of opposing second side faces of said housing space; and another second conductor portion for connecting said card housed in said housing space, said another second conductor portion being disposed in said housing main body and insulated from said contact, said another conductor portion being disposed along the other of the opposing second side faces of said housing space;

whereby said second conductor portions escaping electric charge electrified on said card to said board when connected to said card and said board;

wherein said card is substantially rectangular and said second conductor portions are symmetrically disposed about the direction of inserting said card, wherein each of said second conductor portions has a flexible portion elastically deformable outside and a lock piece disposed along said flexible portion for covering a portion of a face of said housing space for being inserted said card;

whereby said lock pieces is pushed by said card to open outside when said card is inserted into said housing space, and said lock pieces lock said card when said card is housed in said housing space.

17. The connector according to claim 16, wherein said board is a printed wiring board.

18. The connector according to claim 16, wherein said contact is for connecting said board.

19. An electronic component having the connector according to claim 16.

* * * * *